US010515617B2

(12) United States Patent
Canivell Grifols et al.

(10) Patent No.: US 10,515,617 B2
(45) Date of Patent: Dec. 24, 2019

(54) DEVICE FOR CONTROLLING ELECTRONIC MUSICAL INSTRUMENTS

(71) Applicant: LLEVINAC, S.L., Barcelona (ES)

(72) Inventors: Jordi Canivell Grifols, Barcelona (ES); David Mañosa Ripoll, Barcelona (ES); Marta Hereu Ros, Lloret De Mar (ES)

(73) Assignee: LLEVINAC, S.L., Barcelona (ES)

( * ) Notice: Subject to any disclaimer, the term of this patent is extended or adjusted under 35 U.S.C. 154(b) by 0 days.

(21) Appl. No.: 16/252,321

(22) Filed: Jan. 18, 2019

(65) Prior Publication Data

US 2019/0237053 A1 Aug. 1, 2019

(30) Foreign Application Priority Data

Jan. 26, 2018 (EP) ..... 18382047

(51) Int. Cl.
*G10H 1/32* (2006.01)
*G10H 1/34* (2006.01)

(52) U.S. Cl.
CPC ..... *G10H 1/348* (2013.01)

(58) Field of Classification Search
CPC ..... G10H 1/348
USPC ..... 84/746
See application file for complete search history.

(56) References Cited

U.S. PATENT DOCUMENTS 9,620,094 B2 * 4/2017 Abbate ..... G10H 1/32
10,204,609 B2 * 2/2019 Canivell Grifols ..... G10G 5/00
2007/0295190 A1 * 12/2007 Collins ..... G10H 1/32 84/422.1
2014/0131543 A1 * 5/2014 Goto ..... F16M 11/043 248/429
2015/0325224 A1 * 11/2015 Manosa Ripoll ..... G10H 1/32 84/444
2016/0171959 A1 * 6/2016 Canivell Grifols ..... G10G 5/00 84/453
2016/0258574 A1 * 9/2016 Abbate ..... G10H 1/32
2018/0301131 A1 * 10/2018 Jashyn ..... G10H 1/348

FOREIGN PATENT DOCUMENTS

DE 29808857 U1 12/1998
FR 2652682 A1 4/1991
WO 2017/125629 A1 7/2017
WO 2017/178680 A1 10/2017

OTHER PUBLICATIONS

European Search Report for EP Application No. EP18382047, dated Jul. 3, 2018 in 8 pages.

* cited by examiner

*Primary Examiner* — Jeffrey Donels

(74) *Attorney, Agent, or Firm* — Knobbe, Martens, Olson & Bear, LLP

(57) ABSTRACT

A device for controlling electronic musical instruments includes a casing having a base. The casing and the base define the body of the control device. The device also includes a slotted hole for connecting to an instrument pedalboard. The slotted hole is located in a cavity in the body of the control device such that the slotted hole is integrated in the body of the device.

11 Claims, 13 Drawing Sheets

DEVICE FOR CONTROLLING ELECTRONIC MUSICAL INSTRUMENTS

CROSS-REFERENCE TO RELATED APPLICATION

This application claims priority to European Patent Application No. 18382047.1 filed on Jan. 26, 2018, the disclosure of which including the specification, the drawings, and the claims is hereby incorporated by reference in its entirety.

FIELD OF THE INVENTION

The present invention relates to a device for controlling electronic musical instruments, comprising a novel system for being secured to an instrument pedalboard.

BACKGROUND OF THE INVENTION

In the field of musical instruments, it is widely known the use electronic control devices to alter the sound from a sound source, usually electronic musical instruments e.g. an electric guitar. This type of control device is commonly known as an effect pedal.

Effect pedals have traditionally been secured to pedalboards by using fabric strips that have different warps and hook together, marketed under the brand name Velcro®. Despite some benefits, this manner of securing pedals to pedalboards has drawbacks, such as the ease with which pedals can be removed and stolen, and the deterioration of said securing product over time. Due to this, sturdier securing systems have gradually been appearing, such as those described in published Spanish patent application documents ES 2495940 A1 and ES 2625661 A1.

ES 2495940 A1 discloses an adjustable support for electronic musical instruments and the like, comprising a plurality of slots in its top face, along which flanges for securing the control devices can be connected. Said securing flanges consist of a base that can move on the board and is provided with vertical arms that carry elements for securing the control devices, said flanges being able to be secured at any point along the slots in the board.

The above-described system is disadvantageous in that the securing flanges reduce the useful surface area of the pedalboard since they have to be arranged on the sides of the control device or pedal, thus occupying a space that could be used to arrange another control device or pedal.

ES 2625661 A1 discloses a connector for fastening a control pedal, comprising a plate having an opening for connecting to the control pedal and an opening for connecting to the pedalboard, said opening for connecting to be pedalboard being a slotted hole.

One of the disadvantages of the connector described by ES 2625661 A1 is that, in a similar manner to the connection flange disclosed by ES 2495940 A1, the connector protrudes from the pedal body such that the connector-pedal assembly occupies a larger surface area of the pedalboard, thus reducing its useful surface area. In addition, if two control devices are located adjacently to one another, it is difficult to adjust the connections means.

SUMMARY OF THE INVENTION

The forementioned problems by disclosing a device for controlling electronic musical instruments, comprising a casing having a base, said casing and said base defining the body of said control device, and further comprising at least one slotted hole for connecting to an instrument pedalboard, said at least one slotted hole being located in a corresponding cavity in the body of said control device such that the slotted hole is integrated in the body of said device.

In this way, the pedal or control device is firmly secured to the pedalboard, making it extremely difficult to steal the device and without increasing the surface area occupied by the pedal. This makes it possible to place pedals next to one another, maximising the useful surface area of the pedalboard.

In one embodiment, the device comprises a removable cap that covers said cavity.

Covering the cavities with a cap makes it possible to prevent dirt, etc. accumulating in them, which, besides being unsightly, could also damage the means for securing the pedal to the pedalboard. It should also be borne in mind that there is normally a large number of electrical connections on one pedalboard, so the accumulation of dirt would increase the risk of fire in the event of any short circuit or the like.

In one embodiment, the shape of the cap matches the shape of the cavity. This allows the cap to be integrated in the body, i.e. the shape of the cap is the shape the casing would have if there were no cavity, thus making it impossible to notice the cavity at first glance. In addition to all the aforementioned advantages, this provides the control device with superior aesthetic qualities.

In one embodiment, the cavity comprises a plurality of slots into which a plurality of protrusions on the cap fit, such that said cap is firmly secured to the casing of the control device or pedal.

In one embodiment, said at least one slotted connection hole is formed by two matching orifices, a first orifice being located in the casing of said device and a second orifice being located in the base of said device. This allows the (preferably non-permanent) means for securing the pedal to the pedalboard to pass through said slotted connection hole while passing through the base and the casing; this ensures that the casing and base cannot be separated while they are secured in the pedalboard and thereby makes it more difficult to steal the control device or pedal. Preferably, said orifices are slotted holes.

Preferably, the device is parallelepiped-shaped and comprises at least two slotted connection holes, said at least two slotted connection holes being located on opposite sides. Even more preferably, the device is rectangular prism-shaped. However, devices of shapes different from those mentioned above, e.g. cylindrical, are also possible.

In one embodiment, the top face of the casing has at least one additional slotted hole that is aligned at least in part with the at least one slotted connection hole.

In an advantageous embodiment, the means for securing the device to the pedalboard are non-permanent securing means. However, it is also possible to use permanent securing means. In an even more advantageous embodiment, the non-permanent securing means are such as to allow the control device or pedal to be secured to an adjustable support as described in published Spanish patent application document ES 2495940 A1. Other embodiments in which the non-permanent securing means are screws, pins, etc. are also possible.

In one embodiment, the device is secured to a pedalboard having a plurality of slots by means of securing means that comprise a nut threaded to a shank which passes through the slotted connection hole in said device and comprises, at its lower end, an elongated head that can be inserted into a slot in the pedalboard and is held in said slot by being rotated.

Advantageously, said nut is housed in the cavity in which the at least one slotted connection hole is located. Even more advantageously, the top face of said nut abuts the slotted hole in the top face of the casing and the bottom face of said nut abuts the slotted hole for connecting to the pedalboard. It is also possible, however, to use said securing means together with embodiments that do not have said slotted hole in the top face of the casing.

Preferably, the base of the control device comprises a peripheral protrusion that fits together with the inner face of the side walls of the casing of said control device. Alternatively, said peripheral protrusion on the base fits together with a peripheral cavity in the casing.

In one embodiment, on the top face of the casing, the control device has the controls, such as buttons, switches, etc., of the control device. Said controls will vary from one embodiment to the other depending on the effects desired in that specific embodiment.

In one embodiment, the electronic circuits and other components responsible for altering the sound from the source are housed inside the hollow space formed by the casing and the base of the control device. Said electronic circuits and other components will vary from one embodiment to the other depending on the effects desired in that specific embodiment.

According to another aspect of the present invention, a pedalboard and device assembly is also disclosed, a pedal according to the invention being secured to a pedalboard that comprises a plurality of slots, and the elongated head of the securing means being inserted into one of the slots in the pedalboard such as to be held in said slot by being rotated.

Although the present invention has been developed for connecting the control device or pedal to a pedalboard, it is also possible to secure said control device or pedal to a table, a wall, the ground, etc.

The concepts of the "control device" and the "device for controlling electronic musical instruments" are used interchangeably and in an equivalent manner throughout this document. Throughout the text, the terms "pedal" and "effects pedal" are used interchangeably and in an equivalent manner. The concepts of "pedal" and "device for controlling electronic musical instruments" are used interchangeably and in an equivalent manner throughout the text. In this document, the directions horizontal, vertical, up, down, etc. should be understood according to the normal operating position of the control device, i.e. with the base parallel to the ground.

BRIEF DESCRIPTION OF THE DRAWINGS

To aid understanding, drawings showing an embodiment of the device for controlling electronic musical instruments according to the present invention are included by way of explanatory yet non-limiting example.

In the drawings, identical or equivalent elements have been identified by the same numerals.

DETAILED DESCRIPTION OF THE PREFERRED EMBODIMENTS

Figure 1:
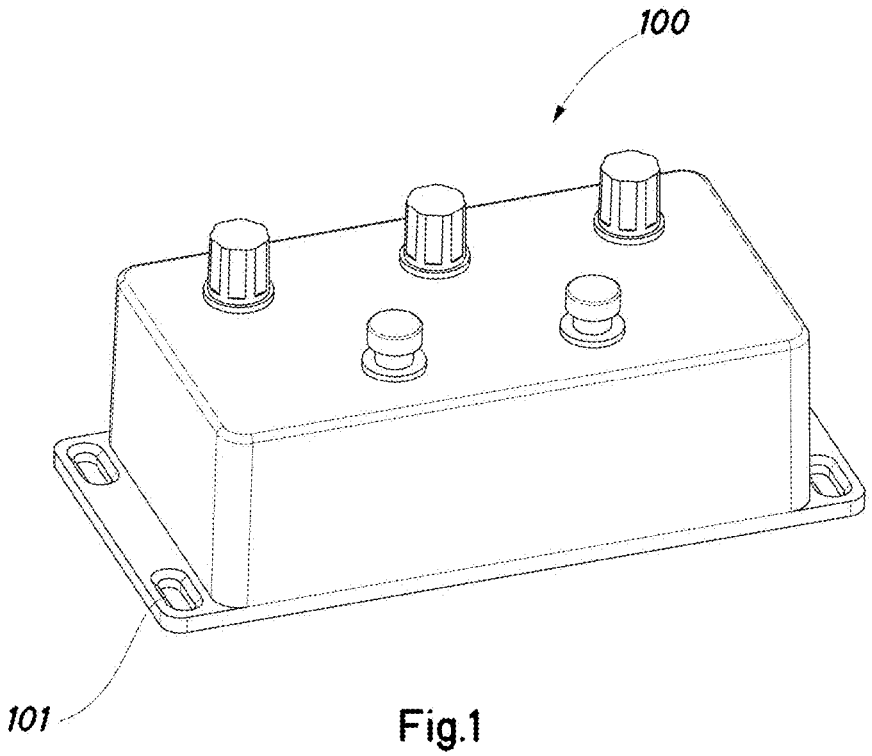
FIG. 1 is a perspective view of a device for controlling electronic musical instruments according to the known prior art.

FIG. 1 shows an effects pedal —100— from the known prior art, having a system for being secured to the pedalboard that has already evolved with respect to the classic system of connecting the pedal to the pedalboard using Velcro®. As can be seen, the base of said prior art pedal has two protrusions protruding from the pedal casing, both protrusions having a pair of slotted holes —101— for connecting the pedal to the pedalboard.

As can be clearly seen, the pedal securing system shown in FIG. 1 increases the surface area occupied by the pedal, reducing the number of pedals that can be placed on a given pedalboard. In addition, by means of the slotted holes —101— in the base, the securing means only connect the base to the pedal, whereas the base is only connected to the casing by means of screws in the corners of said casing (these are hidden in this figure due to the perspective used). As will be seen below, this makes the base-casing connection weaker than that in the embodiments according to the present invention (see FIGS. 2 to 13).

Figure 2:
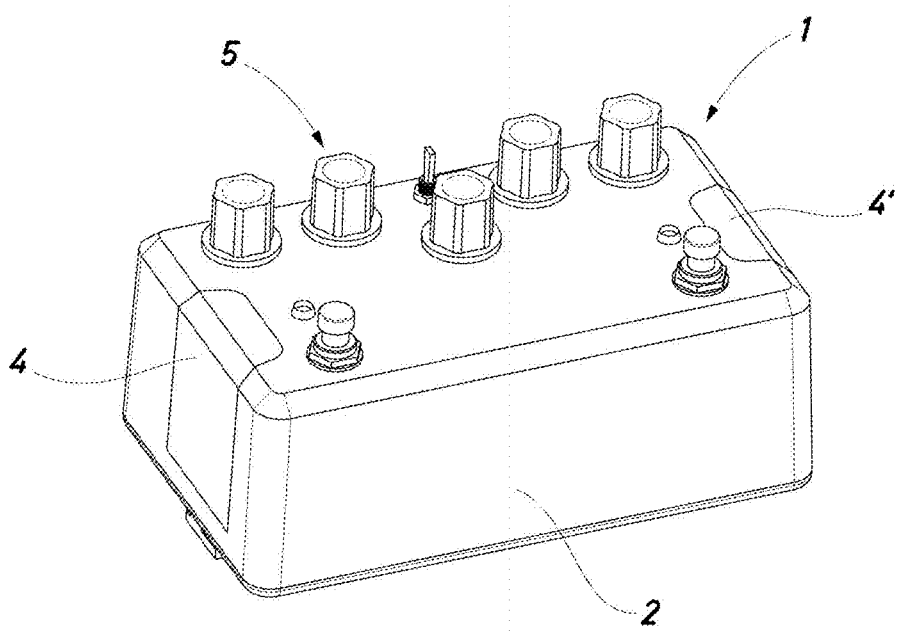
FIG. 2 is a perspective view of a first exemplary embodiment of a control device according to the present invention.

FIG. 2 is a perspective view of a first embodiment of a control device according to the present invention. As can be seen, this figure shows the pedal —1— together with the caps —4—, —4'— fitted into the cavities —21—, —21'— (see FIG. 3) such that, due to the shape of the caps —4—, —4'—, said caps form, together with the casing —2— and the base, a rectangular prism having a chamfer at the upper perimeter thereof.

In the embodiment shown, on its top face the pedal —1— has a plurality of controls —5— that, in addition to switching the pedal —1— on and off, control the various parameters of the effects that said pedal —1— creates.

Figure 3:
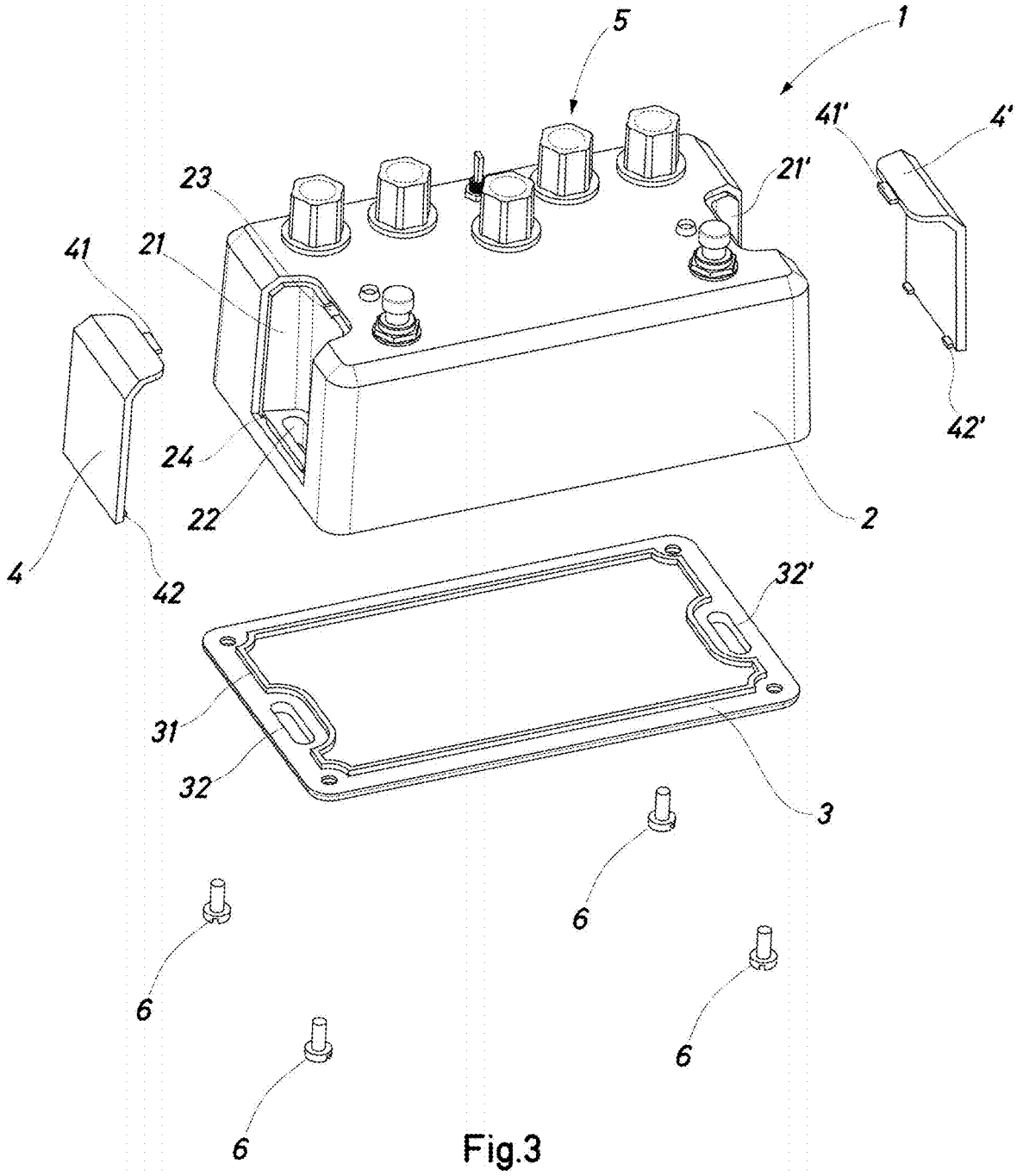
FIG. 3 is an exploded perspective view of a first exemplary embodiment of a control device according to the present invention.

FIG. 3 is an exploded perspective view of the embodiment shown in FIG. 2. In this way, the various parts and components of the pedal —1— can be more clearly seen. As can be seen, in this embodiment, the casing —2— of the control device —1— has two cavities —21—, —21'— in opposite faces. More specifically, if the pedal in this first embodiment is considered to be substantially rectangular prism-shaped, the cavities are arranged on the faces of shorter length.

As can be seen, each one of the cavities —21—, —21'— has its corresponding cap —4—, —4'—. In the embodiment shown, the caps —4—, —4'— are of a shape that matches that of the cavity such that, once placed over the cavity, they are perfectly integrated in the casing —2— of the pedal —1—, adopting the outer appearance of said casing such that the casing —2— and the caps —4—, —4'— appear to form a single body. For this purpose, in the embodiment shown, the upper edge of the caps —4—, —4'— is chamfered in a similar manner to the chamfer on the upper periphery of the casing —2—.

In addition, FIG. 3 shows the plurality of protrusions on the caps —4—, —4'—. Said plurality of protrusions on the caps —4—, —4'— fit together with the plurality of slots in the cavities —21—, —21'—. As can be seen, in this embodiment, each of the caps —4—, —4'— has an upper protrusion —41—, —41'— and pairs of lower protrusions —42—, —42'—. As illustrated, in the embodiment shown, each of the cavities —21—, —21'— has an upper slot —23—, —23'— and pairs of lower slots —24—, —24'— (see FIG. 4 for more detail).

Since said protrusions on the caps —4—, —4'— fit together with said slots in the cavities —21—, —21'— and said caps and said cavities have matching shapes, the caps —4—, —4'— can be firmly secured to the cavities —21—, —21'— and in turn to the casing —2— of the control device —1—.

As can be seen in FIG. 3, the base —3— comprises a peripheral protrusion —31— on its top face, i.e. the surface not in contact with the pedalboard, ground, etc. Said peripheral protrusion —31— is the same shape as the inner periphery of the casing —2—. It is thus ensured that the base —3— is held in place and does not move relative to the casing —2—, making it simpler to mount the pedal —1—, in particular in terms of screwing in the plurality of screws —6— that, in this embodiment, are responsible for connecting the base —3— to the casing —2—. As can be seen, there is a screw —6— in each corner of the pedal in this embodiment.

Figure 4:
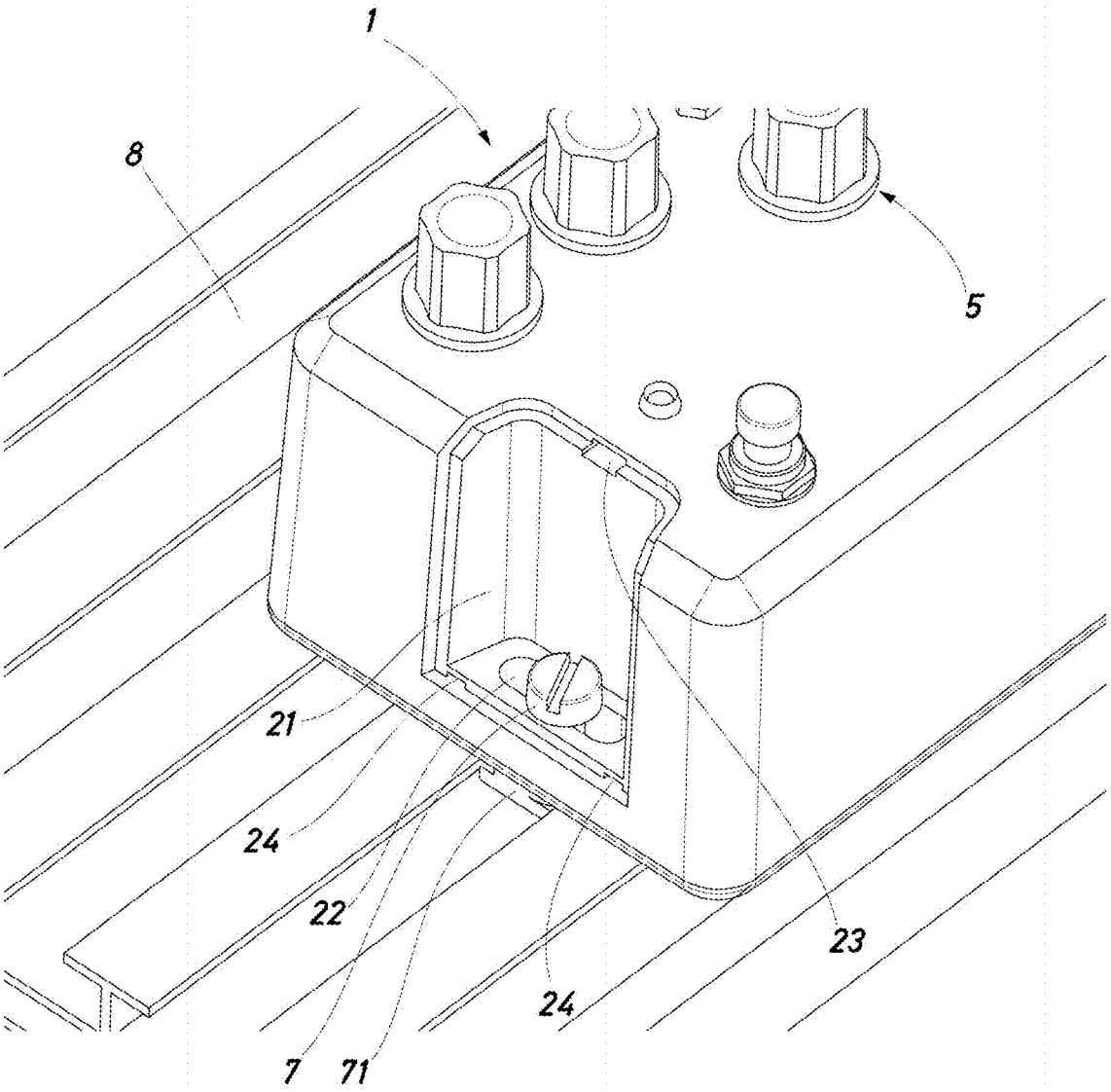
FIG. 4 is a perspective view of a detail of a cavity and its corresponding slotted hole in a first exemplary embodiment of a control device according to the present invention.

In the embodiment shown in FIG. 3, each cavity —21—, —21'— has a slotted hole —22—, —22'— in its lower portion (see FIG. 4). The slotted holes —22—, —22'— in the cavities —21—, —21'—of the casing —2— are vertically aligned with the corresponding slotted holes —32—, —32'—in the base —3— such that, when the base —3— is connected to the casing —2—, the two pairs of slotted holes —22—, —22'— and —32—, —32'— form two single slotted connection holes. When securing the pedal —1— to the pedalboard or another support surface, this feature allows the securing means to strengthen the securing of the casing —2— to its base —3— in addition to securing the pedal to the pedalboard or another support surface, thus making it even more difficult to open the pedal —1— and steal its internal components. This arrangement also makes it more difficult for a potential thief to remove the pedal —1—.

In this first exemplary embodiment, the orifices in the base and in the casing that form the slotted connection holes are also slotted holes. However, other embodiments in which said orifices have a shape other than that of slotted holes are also possible.

The slotted connection holes —22, —32— and —22'—, —32'—are hidden beneath the caps —4—, —4'—. In addition to improving the aesthetics of the assembly, this features also prevents the ingress of dirt, etc. that could damage the securing means passing through the slotted connection holes —22—, —32— and —22'—, —32'—. The accumulation of dirt in the cavities —21—, —21'— and in the corresponding slotted holes would also increase the risk of fire in the event of any short circuit or improper connection (it should be borne in mind that there is usually a large number of electrical connections between different components on the pedalboards).

FIG. 4 shows a cavity —21— in detail, together with its corresponding slotted hole in a first exemplary embodiment of a pedal —1— according to the present invention mounted on a pedalboard —8—. In this figure, a screw —7— is securing the pedal —1— to the pedalboard —8—. To do so, the head of the screw —7— abuts the upper portion of the slotted hole —22—, in turn pressing the slotted hole —22— and the rest of the pedal —1— towards the pedalboard —8— and securing said pedal —1—. This ensures that the pedal is firmly secured to the pedalboard. Although this figure has only shown one cavity and its corresponding slotted hole, it should be noted that the securing system is the same in the other cavity and its corresponding slotted hole.

In addition, FIG. 4 also shows the plurality of slots, consisting of the upper slot —23— and the two lower slots —24— into which the plurality of protrusions on the cap —4— fit (not shown in this figure; see FIG. 3). It can also be seen in this figure that the cavity —21— has a recess around its periphery. This recess is the same size as the thickness of the cap. This allows the cap to fit together with the cavity perfectly, without protruding, such that the upper portion of the cap —4— is flush with the upper portion of the casing —2—.

Figure 5:
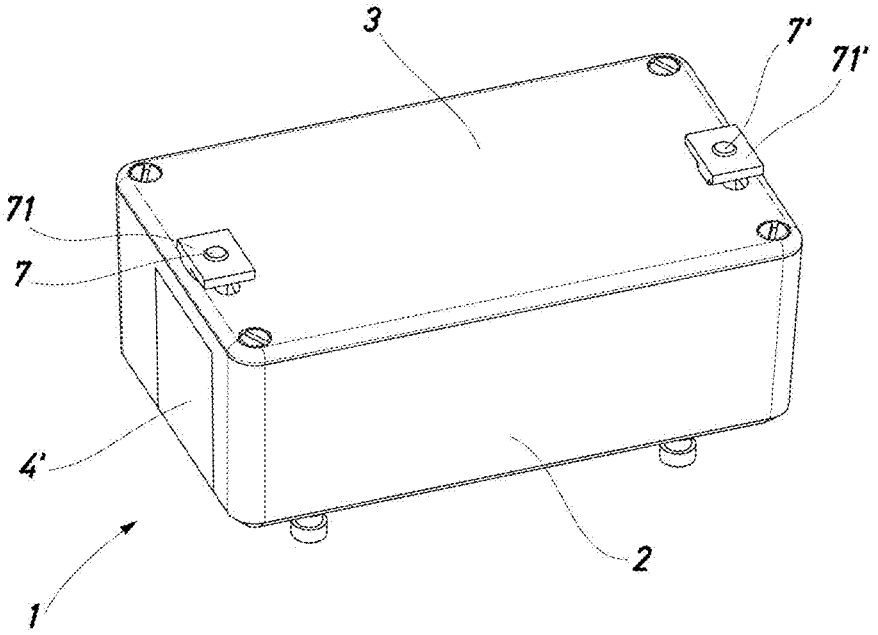
FIG. 5 is a perspective view of a first exemplary embodiment of a control device according to the present invention in an upside-down position.

For explanatory purposes, FIG. 5 shows a first exemplary embodiment of an effects pedal according to the present invention in an upside-down position, thus making it possible to see in detail the face of the base that is in contact with the pedalboard or other surface to which the pedal is secured.

In the exemplary embodiment shown in FIG. 5, the means for securing the pedal —1— to the pedalboard are such as to allow them to be used together with slotted pedalboards as described in published Spanish patent application document ES 2495940 A1. In this embodiment, said securing means consist of a shank —7— that comprises, at one end, a head —71— that is secured to the shank —7— and has two positions defined by means of rotation. In a first position, the heads —71—, —71'— and the other securing means can freely slide along the slot in the pedalboard —8— (see FIGS. 4 and 6), and in the second position, the heads —71—, —71'— are locked in the slot, preventing them from sliding along said slot and thus securing the pedal —1— in the desired location.

Figure 6:
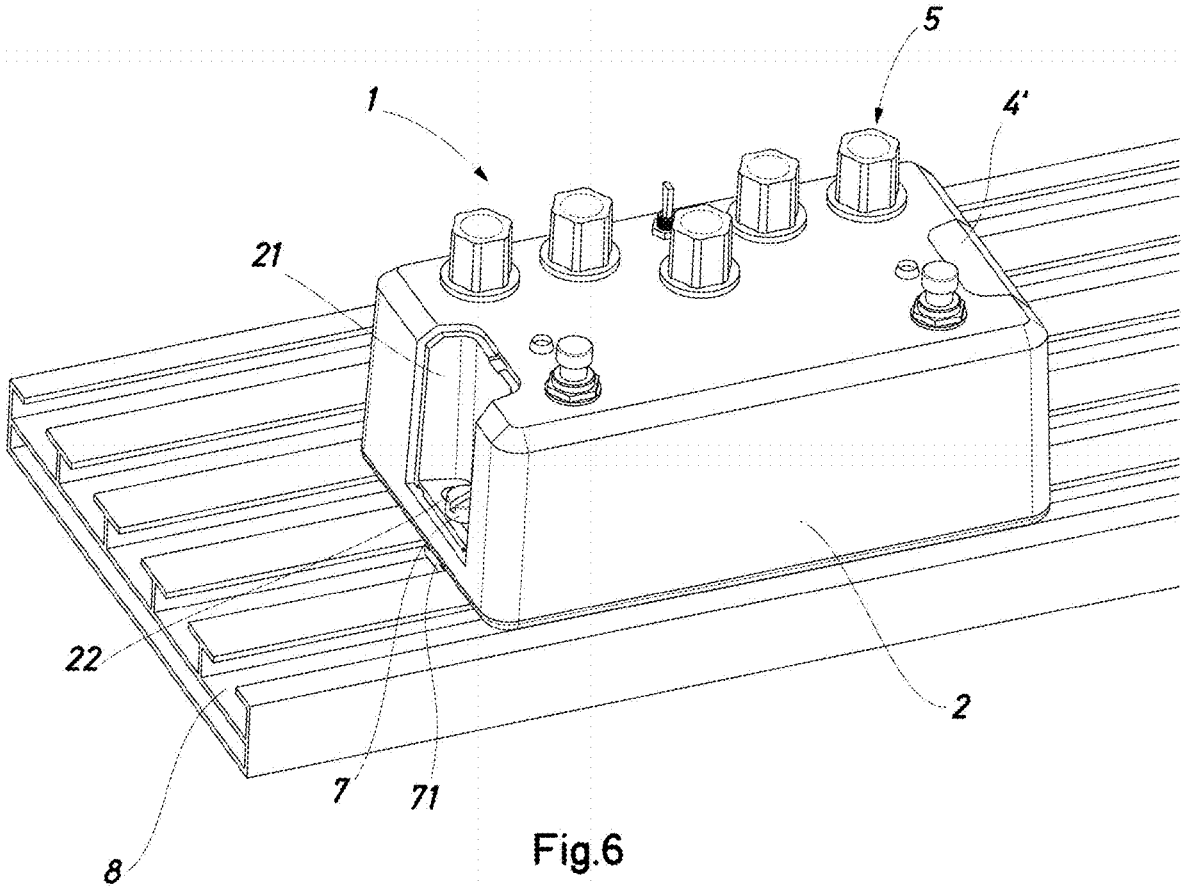
FIG. 6 is a perspective view of a first exemplary embodiment of a control device according to the present invention mounted on a pedalboard.

FIG. 6 shows the pedal —1— shown in FIG. 5 mounted on a pedalboard —8— of the type disclosed in published Spanish patent application document ES 2495940 A1. This type of pedalboard has been shown merely for illustrative purposes since the device for controlling electronic musical instruments according to the present invention can be used with any type of pedalboard or other type of support.

For explanatory purposes, FIG. 6 shows the pedal —1— without one of its caps. However, it should be noted that each cavity would have its corresponding cap mounted when said pedal —1— is in normal use.

In the second exemplary embodiment shown in FIGS. 7 to 13, each cavity —210—, —210'— has a slotted hole —220—, —220'— in its lower portion. The slotted holes —220—, —220'— in the cavities —210—, —210'— of the casing —2'— are vertically aligned with the corresponding slotted holes —320—, —320'— in the base —3'— such that, when the base —3'— is connected to the casing —2'—, the two pairs of slotted holes —220—, —220'— and —320—, —320'— form two single slotted connection holes. Similarly to the first exemplary embodiment shown in FIGS. 1 to 6, when securing the pedal —1'— to the pedalboard or another support surface, this feature allows the securing means to strengthen the securing of the casing —2— to the base —3— in addition to securing the pedal to the pedalboard or another support surface, thus making it even more difficult to open the pedal —1— and steal its internal components. This arrangement also makes it more difficult for a potential thief to remove the pedal —1—.

In this second exemplary embodiment, the orifices in the base and in the casing that form the slotted connection holes are also slotted holes. However, other embodiments in which said openings have a shape other than that of slotted holes are also possible.

Figure 7:
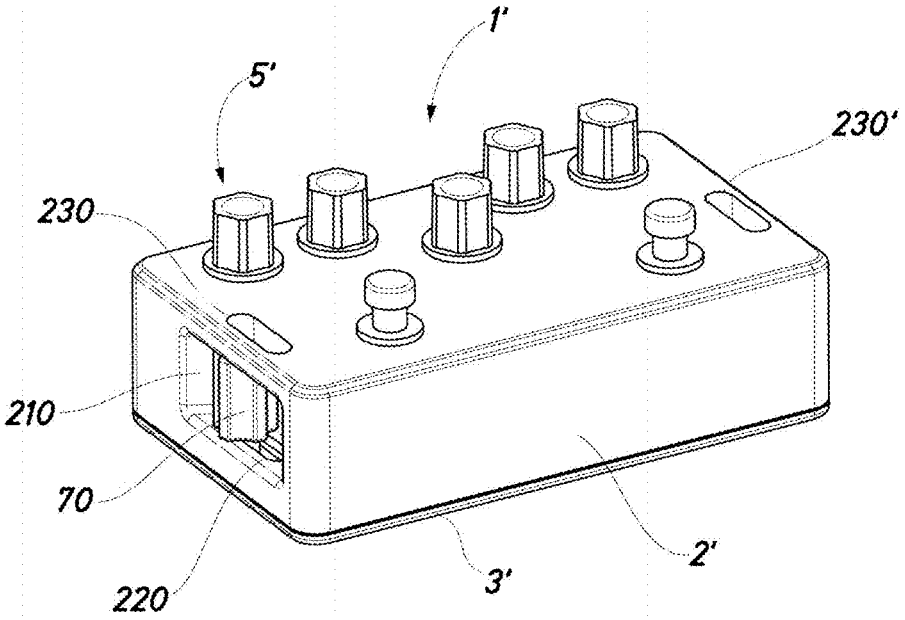
FIG. 7 is a perspective view of a second exemplary embodiment of a control device according to the present invention.

FIG. 7 is a perspective view of a second exemplary embodiment of a control device according to the present invention. As can be seen, one difference between the first exemplary embodiment and this second exemplary embodiment is that the upper portion of the cavity —210— is partially covered in the second exemplary embodiment. It should be noted that in this exemplary embodiment the top face of the casing —2'— has a pair of slotted holes —230—, —230'—that correspond to the cavities —210—, —210'— (the cavity —210'— is hidden in this figure due to the perspective). In this exemplary embodiment, said top face of the casing —2'— additionally has a plurality of controls —5'—that, in addition to switching the pedal —1'— on and off, control the various parameters of the effects that said pedal —1'— creates.

This figure also shows how the cavity —210— has its corresponding slotted hole —220—. Although the cavity —210'— is not visible in this figure due to the perspective, it should be noted that said cavity —210'— also has its corresponding slotted hole —220'—, which is also hidden for the same reasons. In addition, it can also be seen that the body of the pedal —1'— is defined by the casing —2'— and the base —3'—.

In this second exemplary embodiment, the casing —2'— of the control device —1'— has two cavities —210—, —210'— in opposite faces. More specifically, if the pedal in this second exemplary embodiment is considered to be substantially rectangular prism-shaped, the cavities are arranged on the faces of smaller length. It should be noted that other cavity arrangements and other pedal shapes are also possible.

Figure 8:
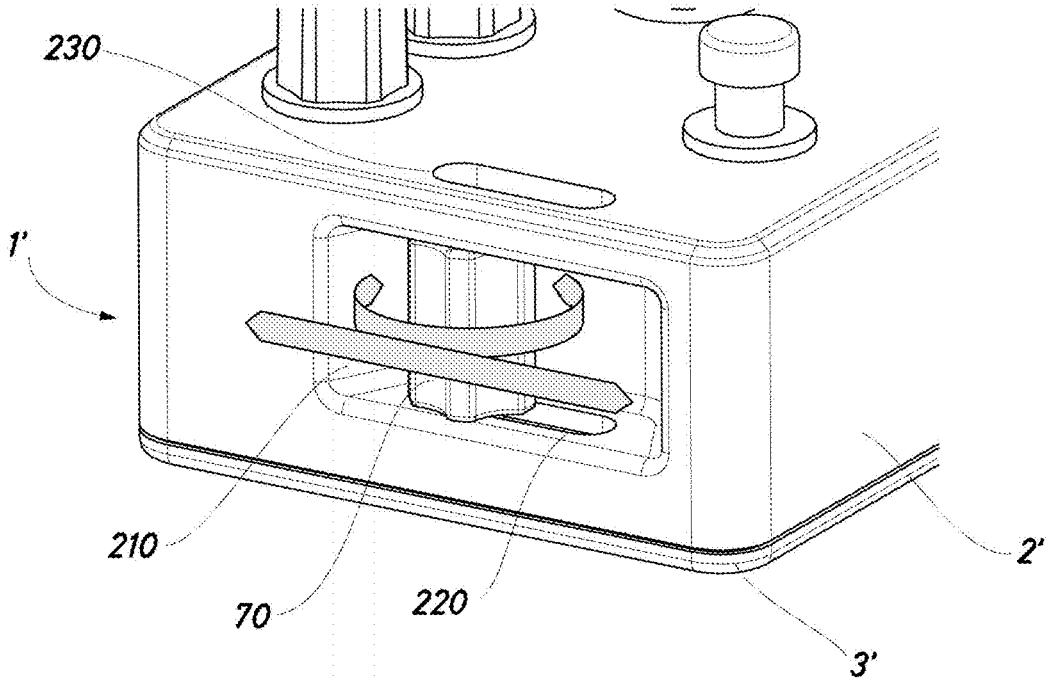
FIG. 8 is a perspective view of a detail of a cavity in a second exemplary embodiment of a control device according to the present invention.

FIG. 8 shows in detail the cavity —210— from the exemplary embodiment shown in FIG. 7. As can be seen, the cavity —210— comprises, in its lower portion, a slotted hole —220— through which the means for securing the pedal —1'— to the pedalboard —8— pass (see FIG. 13). Said securing means will be explained in detail later, but, as can be seen, the nut —70— is housed inside the cavity —210—, which makes it possible to place several pedals next to one another, thereby maximising the number of pedals that can be installed on a given pedalboard or surface. Said nut —70— can rotate about its own axis and/or move along the slotted hole —220—.

In the exemplary embodiment shown, the slotted hole —230— in the top face of the casing —2'— allows the securing means to be adjusted when it is not possible to do so from the cavity —210— due to the access thereto being blocked by an adjacent pedal or any other element blocking access to said cavity —210—. Due to the elements described in this paragraph being arranged symmetrically in this embodiment, the explanations here also apply to the cavity —210'—, slotted hole —230'—, slotted connection hole —220'— and the other elements.

Figure 9:
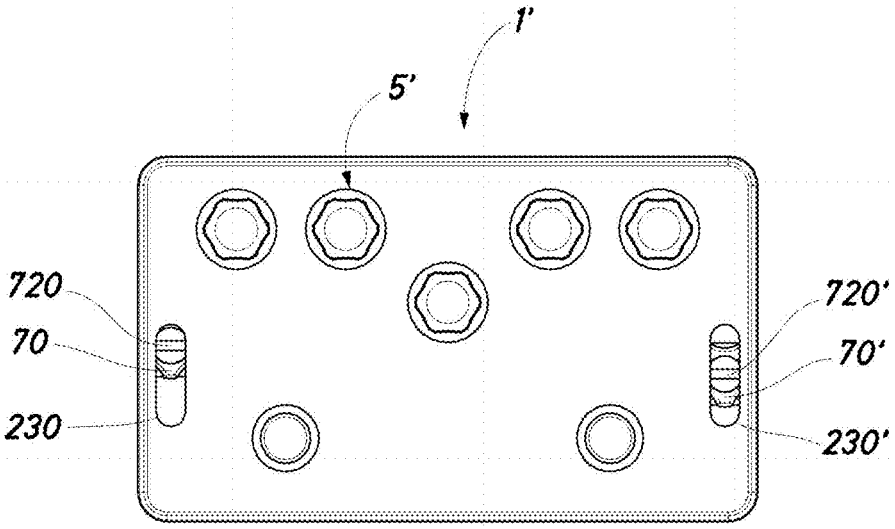
FIG. 9 is a plan view of a second exemplary embodiment of a control device according to the present invention.

FIG. 9 is a plan view of the second exemplary embodiment of a pedal according to the present invention. In this way, it is possible to clearly see that, in this embodiment, the nuts —70—, —70'— of the securing means are housed in the cavities and do not protrude from the casing of the pedal —1'—. Owing to this view, it is also possible to clearly see that the slotted holes —230—, —230'—enable access to the regions —720—, —720'— for receiving the securing means and that said securing means can move longitudinally along the slotted holes, making it possible to better adjust the position of the pedal —1'— relative to the pedalboard or surface on which it is installed.

Figure 10:
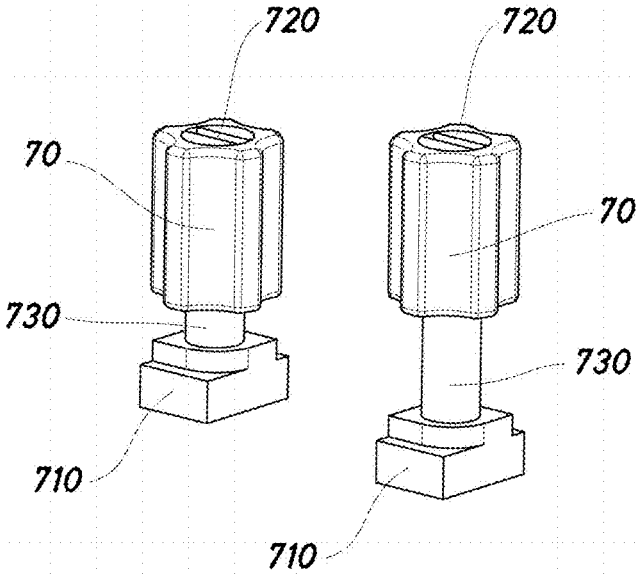
FIG. 10 is a perspective view of securing means according to the present invention, in a retracted position and an extended position.

FIG. 10 shows securing means according to the present invention. In this figure, said securing means have been shown in a retracted position and an extended position. As can be seen, said securing means comprise a nut —70— threaded to a shank —730—. At its lower end, said shank —730— has an elongated head —710— that can be inserted into a slot in a slotted pedalboard (see FIG. 13) and is held in said slot by being rotated. In the upper region of the nut —70—, the receiving region —720— is located, which has one or more slots that, depending on the embodiment, allow said receiving region —720— to be actuated by a screwdriver of the flat-head, Phillips or Allen type, etc., or another type of similar tool, thus actuating the lower head in a rigidly connected manner for it to pass from the free position to the locked position or vice versa.

Figure 11:
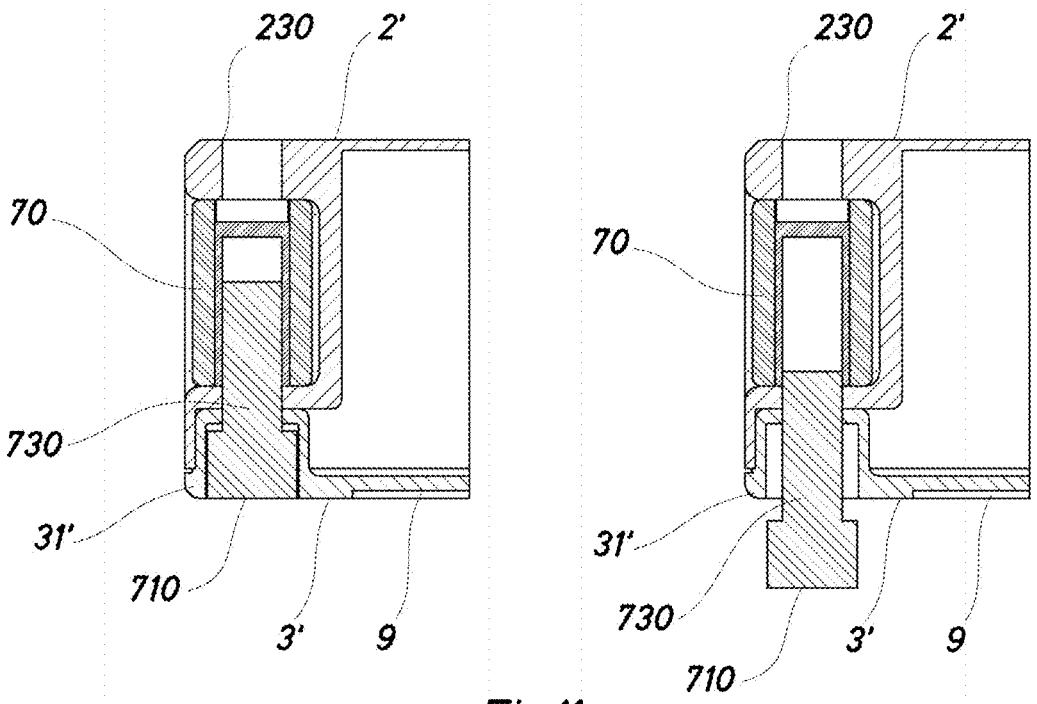
FIG. 11 is a detailed view of a section through securing means mounted on a second exemplary embodiment of a control device according to the present invention.

FIG. 11 shows the securing means from FIG. 10 in a second exemplary embodiment of a pedal according to the present invention. In the embodiment shown, in addition to being housed inside the cavity —210— in the casing —2'—, the nut —70— also abuts the lower portion of the slotted hole —230— by means of its upper portion, and abuts the upper portion of the slotted connection hole —220— by means of its lower portion. In this way, since the nut —70— cannot move in the longitudinal direction, rotating said nut thus leads to the shank —730— and its head —710— moving longitudinally; in other words, when the pedal —1'— is in the normal operating position, said shank —730— and its corresponding head —710— move upwards and downwards. As can be seen, in the exemplary embodiment shown, the base —3'— is shaped such as to form a receptacle —310— for housing the head —710— of the connection means when they are in the retracted position, such that the lower surface of the pedal —1'— is completely planar.

It can also be seen in this figure that, in this exemplary embodiment, the base —3'— has a peripheral protrusion —31'— that secures the base —3'— to the casing —2'— owing to the dimensional interference. As will be seen below, said securing of the base —3'— to the casing —2'— is reinforced and ensured by means of a plurality of screws (see FIG. 12).

Figure 12:
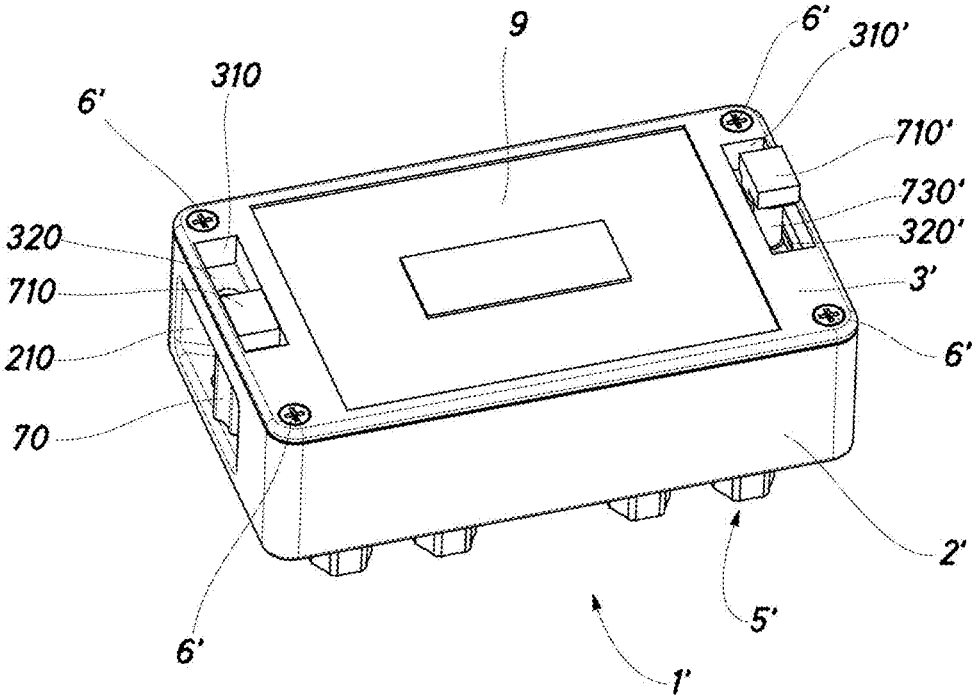
FIG. 12 is a perspective view of a second exemplary embodiment of a control device according to the present invention in an upside-down position.

FIG. 12 shows the second exemplary embodiment of a pedal —1'— according to the present invention in an upside-down position, thus making it possible to clearly see the base —3'—and said pedal —1'—. It can be seen in this figure that the base —3'— is screwed to the casing —2'— by means of a screw —6'— in each corner. Since the heads of the screws —6'— are only accessible from the base —3'—, said screws —6'— are no longer accessible once the pedal —1'— is mounted on the pedalboard, thus making it extremely difficult for the pedal —1'— to be opened by a person seeking to steal or tamper with the internal components. This feature is reinforced by the fact that, as already mentioned, the means for securing the pedal to the pedalboard pass through the casing —2'— and the base —3'—.

For illustrative purposes, some securing means have been shown in a retracted position and others in an extended position. In this way, it can be seen that the head —710— is housed within the receptacle —310— whereas the head —710'— protrudes from its corresponding receptacle —310'— as it would if the pedal —1'— were secured to a pedalboard. In this view, it can also be seen that the securing means pass through the slotted holes —320—, —320'— in the base —3'—.

Since the pedal —1'— has been shown in an upside-down position in FIG. 12, the substitute plate —9— can be clearly seen. As can be seen, in the exemplary embodiment shown, said substitute plate is substantially rectangular and comprises an opening which, in this embodiment, is also substantially rectangular. The substitute plate —9— fits together with the base —3'— as a result of dimensional interference and its purpose is to be able to be separated from the base —3'— in order to place Velcro® or the like in the hole in the base —3'— intended for housing said substitute plate —9—, in such a way that, if the user deems it appropriate, they can secure the pedal to the pedalboard by means of Velcro®, as has been done in the past. As can be easily concluded, the use of Velcro® to secure the pedal according to the present invention is completely compatible with the additional and simultaneous use of the slotted connection holes. The purpose of the substitute plate —9— is to cover the recess intended for housing the Velcro® such that the base —3'— is completely planar when said Velcro® is not present.

Although this document has only shown the substitute plate in the second exemplary embodiment, it should be noted that said substitute plate —9— is an optional element that can be added to any embodiment of a pedal according to the present invention.

Figure 13:
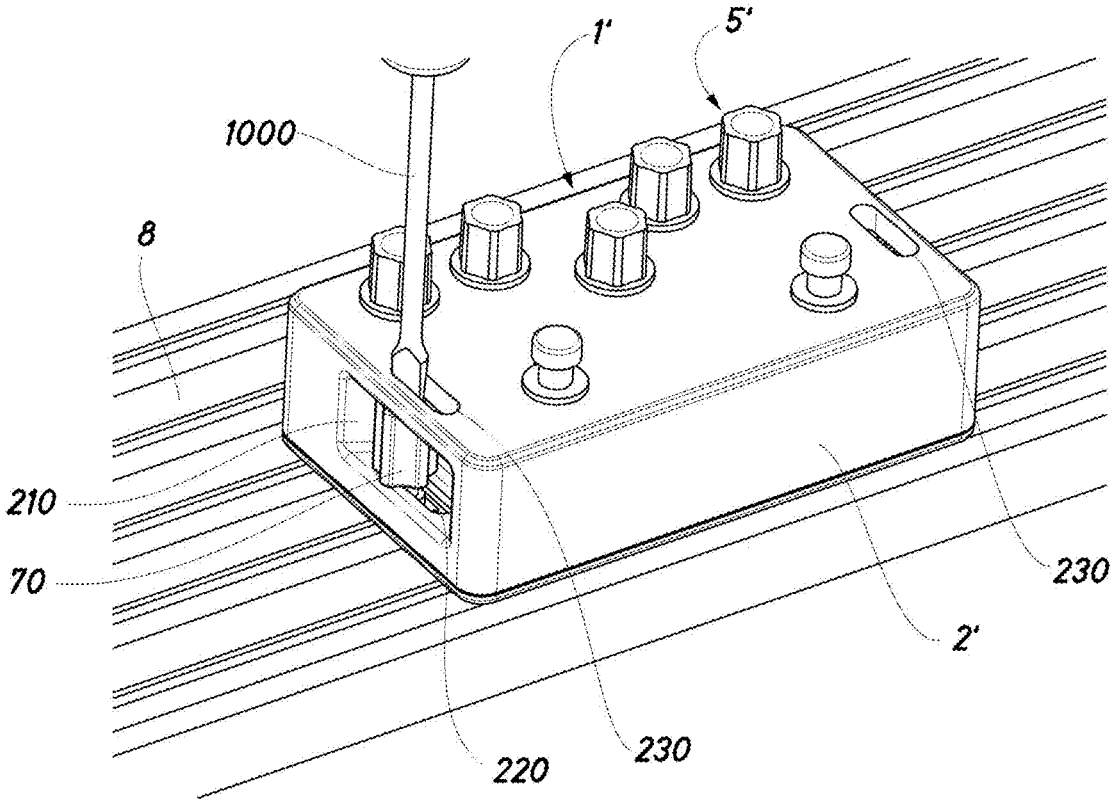
FIG. 13 is a perspective view of a second exemplary embodiment of a control device according to the present invention mounted on a pedalboard.

FIG. 13 shows the second exemplary embodiment of a pedal according to the invention mounted on a pedalboard of the type disclosed in published Spanish patent application document ES 2495940 A1. As can be seen, the slotted hole —230— allows a screwdriver —1000— or the like to pass through in order to adjust the means for securing the pedal —1'— to the pedalboard —8—. More specifically, the screwdriver —1000— adjusts the region —720— (see FIGS. 9 and 10) for receiving the nut —70—, rotating the elongated head —710— (see FIGS. 10 to 12) and locking same in the slot in the pedalboard —8— into which it is inserted, by means of dimensional interference. Similarly to that described above, if a user wishes to release the pedal —1'—, by means of the screwdriver —1000— or the like inserted through the slotted hole —230—, the receiving region —720— would be rotated until the elongated head —710— rotates, in a rigidly connected manner, until it passes from the locked position to the free position.

Although the second exemplary embodiment has been shown without caps covering the cavities —210—, —210'—, it should be noted that similar embodiments comprising caps covering said cavities are also possible.

Although the above paragraphs have described the use of a pedal —1—, —1'— according to the present invention in conjunction with a specific type of means for connecting the pedal and pedalboard, it should be noted that it is also possible to use said pedal —1—, —1'— or the like together with other types of non-permanent connection means, such as screws, nails, pins, etc., or even together with permanent connection means, e.g. rivets.

The use of a slotted connection hole, for a fixed position of the means for securing the pedal to the pedalboard, allow the pedal —1—, —1'— to be moved relative to said securing means, making it possible to better adjust the position of the pedal —1—, —1'— relative to the pedalboard or surface on which it is installed.

The embodiments of the pedal that are shown in the figures are advantageous in that they can be arranged next to one another without the need to leave free space therebetween. This maximises the number of pedals that can be installed on a given pedalboard. Another advantage of the present invention is that, when several pedals are assembled next to one another, it is simple to access the head of the screw or the like, even if several pedals are very close together, since the slotted holes do not protrude from the body of the pedal.

For explanatory purposes and to simplify the figures, the various electronic components (printed circuit boards, transistors, etc.) responsible for altering the sound from the source have not been shown. However, it should be noted that these would be housed in the receptacle defined by the casing and the base.

Although the invention has been set out and described with reference to embodiments thereof, it should be understood that these do not limit the invention, and that it is possible to alter many structural or other details that may prove obvious to persons skilled in the art after interpreting the subject matter disclosed in the present description, claims and drawings. In particular, all the features of each different embodiment and variant shown and/or suggested can in principle be combined with one another, unless explicitly stated otherwise. Therefore, the scope of the present invention includes any variant or equivalent that could be considered covered by the broadest scope of the following claims.

What is claimed is:

1. A device for controlling electronic musical instruments comprising:

a casing, a base, said casing and said base defining a body of said control device, and at least one slotted connection hole for connecting to an instrument pedalboard, wherein said at least one slotted connection hole is located in a corresponding cavity in the body of said control device such that the slotted hole is integrated in the body of said device, wherein said at least one slotted connection hole is formed by two matching orifices, a first orifice being located in the casing of said device and a second orifice being located in the base of said device, and the first orifice and the second orifice comprise a closed curve and are aligned each other.

2. The device according to claim 1, wherein the device is parallelepiped-shaped and comprises at least two slotted connection holes, said at least two slotted connection holes being located on opposite sides.

3. The device according to claim 1, further comprising a connector that comprise a nut threaded to a shank that passes through the slotted connection hole in said device and comprises an elongated head at its lower end.

4. The device according to claim 3, wherein said nut is housed in the cavity in which the at least one slotted connection hole is located.

5. The device according to claim 1, wherein a top face of the casing has at least one additional slotted hole that is aligned at least in part with the at least one slotted connection hole.

6. The device according to claim 3, wherein a top face of said nut abuts at least one additional slotted hole in a top face of the casing and a bottom face of said nut abuts the slotted connection hole for connecting to the pedalboard.

7. The device according to claim 1, further comprising a removable cap that covers said cavity.

8. The device according to claim 7, wherein the shape of the cap matches the shape of the cavity.

9. The device according to either claim 7, wherein the cavity comprises a plurality of slots into which a plurality of protrusions on the cap fit.

10. A pedalboard and device assembly, comprising a device according to claim 3, wherein said device is secured to a pedalboard that comprises a plurality of slots, and the elongated head of the connector is inserted into one of the slots in the pedalboard so as to be held in said slot by being rotated.

11. A device for controlling electronic musical instruments comprising:

a casing having a base, said casing and said base defining a body of said control device, at least one slotted connection hole for connecting to an instrument pedalboard, and a connector that comprise a nut threaded to a shank that passes through the slotted connection hole in said device and comprises an elongated head at its lower end, wherein said at least one slotted connection hole is located in a corresponding cavity in the body of said control device such that the slotted hole is integrated in the body of said device, and wherein a top face of said nut abuts at least one additional slotted hole in a top face of the casing and a bottom face of said nut abuts the slotted connection hole for connecting to the pedalboard.

* * * * *